US009758933B2

(12) United States Patent
Krieg et al.

(10) Patent No.: US 9,758,933 B2
(45) Date of Patent: Sep. 12, 2017

(54) BASE PLATE AND RAIL FASTENING ARRANGEMENT

(71) Applicant: Vossloh-Werke GmbH, Werdohl (DE)

(72) Inventors: Nikolaj Krieg, Hagen (DE); Michael Jonca, Ludenscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 0 days.

(21) Appl. No.: 14/903,386

(22) PCT Filed: Jul. 10, 2014

(86) PCT No.: PCT/EP2014/064846
§ 371 (c)(1),
(2) Date: Jan. 7, 2016

(87) PCT Pub. No.: WO2015/004252
PCT Pub. Date: Jan. 15, 2015

(65) Prior Publication Data

US 2016/0160450 A1 Jun. 9, 2016

(30) Foreign Application Priority Data

Jul. 10, 2013 (DE) ..... 10 2013 107 320

(51) Int. Cl.
*E01B 9/40* (2006.01)
*E01B 9/44* (2006.01)

(52) U.S. Cl.
CPC . *E01B 9/40* (2013.01); *E01B 9/44* (2013.01)

(58) Field of Classification Search
CPC ..... Y10S 411/922; E01B 9/06; E01B 9/40; E01B 29/26; E01B 9/12; E01B 9/44; E01B 9/48; E01B 2201/04
See application file for complete search history.

(56) References Cited

U.S. PATENT DOCUMENTS

| | | | | |
|---|---|---|---|---|
| 2,650,032 A | | 8/1953 | Godfrey | |
| 3,469,784 A | * | 9/1969 | Campbell | E01B 5/14 238/287 |
| 4,108,378 A | | 8/1978 | Raymond | |
| 4,260,105 A | * | 4/1981 | Phillips | E01B 9/40 238/287 |

(Continued)

FOREIGN PATENT DOCUMENTS

| | | |
|---|---|---|
| DE | 605362 | 11/1934 |
| DE | 609247 | 2/1935 |

(Continued)

*Primary Examiner* — Mark Le
(74) *Attorney, Agent, or Firm* — The Webb Law Firm

(57) ABSTRACT

A base plate includes a lateral support section and a lateral contact surface which delimits a supporting area formed on a top side of the base plate for a foot of a rail. A through-hole leading from the top side to the underside of the support section is formed into an edge area of the support section abutting the lateral contact surface. The through-hole has a basic shape which is angular in cross-section. The surface of the edge area meets with the contact surface in an upper marginal edge. A lateral surface of the through-hole assigned to the contact surface at least over a partial area of its height changes into an inclined surface which rises in the direction of the upper marginal edge of the contact surface and ends at the surface of the edge area.

14 Claims, 4 Drawing Sheets

(56) References Cited

U.S. PATENT DOCUMENTS

| | | | | |
|---|---|---|---|---|
| 2004/0155117 | A1 | 8/2004 | Urmson, Jr. et al. | |
| 2008/0179419 | A1* | 7/2008 | Vives Clavel ..... | E01B 9/38<br>238/264 |
| 2009/0108086 | A1 | 4/2009 | Mospan et al. | |

FOREIGN PATENT DOCUMENTS

| | | | |
|---|---|---|---|
| EP | 1950347 | A2 | 7/2008 |
| RU | 110383 | U1 | 11/2011 |
| RU | 111542 | U1 | 12/2011 |

* cited by examiner

BASE PLATE AND RAIL FASTENING ARRANGEMENT

CROSS-REFERENCE TO RELATED APPLICATIONS

This application is the United States national phase of International Application No. PCT/EP2014/064846 filed Jul. 10, 2014, and claims priority to German Patent Application No. 10 2013 107 320.4 filed Jul. 10, 2013, the disclosures of which are hereby incorporated in their entirety by reference.

BACKGROUND OF THE INVENTION

Field of the Invention

The invention relates to a base plate for a rail fastening arrangement, or rail fastening point, having at least one lateral support section which has a lateral contact surface which delimits a supporting area formed on the top side of the base plate, extending over the width of the base plate and for the foot of a rail for a rail vehicle which is to be attached to the base plate. A through-hole leading from the top side to the underside of the support section is formed into an edge area of the support section abutting on the lateral contact surface, to insert a rail spike through it, this through-hole having a basic shape which is angular when viewed taken in cross-section transverse to its longitudinal axis. The surface of the edge area meets with the contact surface in an upper marginal edge which extends over the width of the base plate.

Description of Related Art

Base plates of this kind are in particular used in rail fastening points which are mounted on wooden sleepers. The base plate, on the one hand, serves to laterally guide the rail respectively fastened in the fastening point. On the other hand, the base plate distributes the load, which occurs when a rail vehicle drives over the fastening point, evenly onto the sleeper.

In order enable these functions, base plates of the kind under discussion here, which are known from practice and are used in large numbers in the field, are usually manufactured from a ferrous material which ensures that the component has a sufficiently high strength. Typically, base plates of this kind are rolled from steel as rolled-steel sections. At the same time, the known base plates usually have two support sections, each of which is arranged laterally to the supporting area of the base plate. Each of the support sections in this way forms a lateral stop collar with its contact surface assigned to the rail foot when the rail fastening point is fully mounted, via which the forces arising when the rail fastening point is driven over can be absorbed and dissipated into the sleeper.

The base plate is usually fastened to the sleeper by means of rail spikes which are driven with their spike shafts through the base plate into the sleeper. The spike head of the rail spike protrudes far enough in the direction of one side of the spike that, when it is driven into the through-hole of the base plate present near the contact surface of the respective support section, it rests, when correspondingly aligned, with its free front end on the top side of the foot of the rail to be fixed in the respective rail fastening point. It is ensured that the rail spike is positioned correctly and in a torsion-proof manner by adapting the cross-sectional shape of the respective rail spike to the angular cross-sectional shape of the assigned through-hole such that the spike fits in a form-fit manner in the through-hole when the rail fastening point is fully mounted and correspondingly any rotation around the longitudinal axis of the spike is prevented.

In order to also secure the base plate against turning on the sleeper, additional through-holes further away from the supporting area and offset in relation to one another can be formed into the support sections of the base plate, through which respectively a rail spike of the kind explained above is knocked in. In that case the rail spikes in question do not tact with their rail heads on the rail foot but rather on the top side of the respective support section and in this way fixate the base plate on the sleeper. The hole pattern in which the through-holes are arranged can be chosen such that even under high dynamic forces acting both in the horizontal direction transverse to the rail to be fastened and in the vertical direction of gravity it is ensured that the base plate is held firmly on the sleeper.

However, in practice, it has become apparent that in those areas in which the angular rail spikes are supported against the base plate cracks form which, despite the high strength and wear resistance of the steel material from which the known base plates are usually manufactured, lead to the base plates quickly becoming unfit for use.

SUMMARY OF THE INVENTION

Against the background of the above explained prior art, the object of the invention consisted was to provide a base plate by means simple measures, which can be produced cost-effectively and in which a high utility value is ensured over a long period of use. A correspondingly designed rail fastening point should also to be developed, which should over a long service life, enable to securely attach a rail for rail vehicles to be securely attached even under high dynamic loads.

Correspondingly a base plate for a rail fastening point according to the invention has, in line with the prior art explained in the introduction, at least one lateral support section which has a lateral contact surface which delimits a supporting area formed on the top side of the base plate, extending over the width of the base plate for the foot of a rail for a rail vehicle which is to be attached to the base plate, wherein a through-hole leading from the top side to the underside of the support section is formed into an edge area of the support section abutting on the lateral contact surface, to insert a fastening element through it, this through-hole having a basic shape which is angular in cross-section, and wherein the surface of the edge area meets with the contact surface in an upper marginal edge. According to the invention, the lateral surface of the through-hole assigned to the contact surface at least over a partial area of its height changes into an inclined surface which rises in the direction of the upper marginal edge of the contact surface and ends at the surface of the edge area.

Thus, according to the invention, an inclined surface is formed on the peripheral surface of that through-hole assigned to the contact surface of the support section, through which a rail spike intended for holding down the rail is inserted during the mounting process. This inclined surface ensures that the fastening means, if contact with the base plate occurs, rests with its head, which transfers the retaining force, in full surface contact on the base plate. This proves to be particularly advantageous if the rail spike also has an inclined surface on its underside assigned to the base plate, the inclination and shape of which inclined surface corresponds with the inclined surface provided according to the invention in the through-hole such that in each case a full surface contact of the inclined surface of the through-hole with the inclined surface on the underside of the rail spike occurs. The high dynamic forces absorbed by the rail spike and dissipated into the base plate in operation are consequently no longer concentrated on extremely small linear or punctual contact zones but are transferred over a larger area. This measure, as a result, already prevents the risk of crack formation, of fracturing in the narrow material section of the respective support section remaining between the through-hole and the supporting area or of early abrasive wearing of the rail spike or base plate. The forces which occur when a rail supported on the base plate is driven over and which are aligned transverse to the rail are dissipated better into the base plate and the base structure supporting it formed by the respective sleeper.

These advantages gained by the invention already become apparent if the base plate is manufactured in a conventional manner from a steel material. The locally occurring compression can also be reduced here by the formation of the through-holes according to the invention to the extent that the risk of crack formation is reduced. The advantages of the invention become markedly noticeable if the base plate is manufactured from a plastic material, in particular a fibre-reinforced plastic material, such as a polyamide material having a sufficient glass fibre proportion. The shape of the through-hole proposed according to the invention, particularly with a base plate produced in such a way, allows a controlled transfer of the forces and, at the same time, taking advantage of the special properties of the respective plastic material, also allows the material to be compressed to a certain degree without destroying it. Instead of using the heavy rolled-steel base plates, by using a plastic base plate the invention therefore enables a certain degree of flexibility to be introduced into the respective rail fastening point. At the same time, base plates consisting of plastic can be manufactured considerably more cheaply than base plates of the kind under discussion rolled from steel or produced in a comparable way. The flexibility of the individual sections of the base plate obtained according to the invention with manufacture from plastic results in a marked improvement in the durability, particularly in the area of the contact surface, via which the respective support section absorbs the forces coming from the rail. In addition, the advantages of manufacturing a base plate from plastic also become particularly apparent if the base plate is to be used in a highly corrosive environment. Such a situation is, for example, the case with level crossings, where base plates consisting of steel corrode severely particularly in winter as a result of the use of de-icing agents.

The angle of inclination of the inclined surface in relation to the longitudinal axis of the through-hole should be chosen corresponding to the shape of the rail spike, which is to be inserted through the through-hole when used. The height at which the inclined surface in the through-hole begins should also be determined by taking into account the geometry of the respective rail spike. Here, it has proved of value if the inclined surface extends over at least a sixth, in particular at least a quarter, of the through-hole.

The risk of damage to the material section remaining between the respective contact surface and the through-hole assigned to it and formed closest adjacent to it, can be further reduced, if the inclined surface rests with its upper edge, with which it ends on the surface of the edge area, on the upper marginal edge of the contact surface. In this way, the area in which a concentration of vertical forces can occur is reduced to a minimum. Alternatively, it is also conceivable to slightly decrease the area of the respective material section of the base plate, over which the respective rail spike in use extends with its spike head, so that at most only slight surface pressure occurs in this area.

As already mentioned, the shape of the inclined surface and its inclination can be chosen corresponding to the shape and inclination of the inclined surface present on the underside of the assigned rail spike. In practice, it has proved particularly versatile if the inclined surface provided according to the invention on the through-hole is curved, in particular if it forms the outer peripheral surface of a cylinder segment. The axis, around which the curve of the inclined surface is formed, is optimally aligned parallel to the contact surface of the respective support section and transverse to the longitudinal axis of the through-hole. However, any other shape of the inclined surface can also be suitable. In particular, the inclined surface can be formed flat and rise with a linear gradient in the direction of the upper edge of the assigned contact surface.

The risk of crack formation as a result of notch effects can be additionally reduced by respectively forming a groove into the corner areas of the through-hole, in which the lateral surface of the through-hole, which is assigned to the contact surface, at least outside of its inclined surface butts against the lateral surfaces of the through-hole respectively adjoining it there. The groove in question can be U-shaped, so that a leg surface of the groove forms an extension of the lateral surface of the through-hole assigned to the contact surface. In the case that the lateral surface assigned to the contact surface of the respective support section is aligned parallel to the contact surface, in this case the leg surfaces of the groove are consequently also aligned parallel to the contact surface. In order to also reduce the risk of notch effects in the corner areas between the inclined surface and the lateral surfaces abutting on it, the groove can extend into this area, wherein then the leg surface of the respective groove adjoining the inclined surface is inwardly curved in such a way that viewed in cross-section, on the one hand, it tangentially clings to the base surface of the groove and, on the other hand, it butts against the lateral edge of the inclined surface assigned to it. The inward curvature of the leg surface of the groove which is then present in the area of the inclined surface has the additional advantage that the surface pressure with a rail spike inserted through the respective through-hole and driven into the sleeper lying under it is also reduced to a minimum there.

The formation of a base plate according to the invention proves to be particularly advantageous if the respective through-hole has a rectangular cross-section with two lateral surfaces aligned parallel to the contact surface of the respective support section.

The corner areas of the lateral surfaces of the through-hole abutting on one another, into which no groove is to be formed, can also be hollowed out in a fillet-shaped manner, in order to prevent notch effects.

Of course, if necessary, two or more through-holes formed according to the invention can be formed into the support section and distributed spaced apart from one another along the upper marginal edge of the contact surface of the support section.

Principally, the advantages of the invention already become apparent if only one support section is provided on a base plate according to the invention, which guides a rail on its one longitudinal side. Two such base plates can then be provided in one rail fastening point, each of which is allocated to one of the longitudinal sides of the rail, so that, in this way, the guidance of the rail on both sides is ensured. However, this function can also be combined in one base plate, in a manner which is known per se, by the base plate having two support sections, each of which is provided with at least one through-hole formed in the manner according to the invention, wherein the support sections with their opposing contact surfaces delimit the supporting area in each case on one of its sides.

In order to enable the base plate to be fastened to the respective sleeper in an optimum way, in the case of a sleeper according to the invention, an additional through-hole leading from the top side to the underside of the base plate and offset in the direction of the outer narrow side of the base plate remote from the supporting area can also be formed into at least one of the support sections, wherein this additional through-opening is having at least one lateral surface which at least in one surface section abutting on the surface of the support section is inclined rising in the direction of the surface of the support section. By means of this design, contact between the spike head and the base plate, which is no longer a punctual but rather a full-surface contact, is also made possible in the area of the through-holes arranged further away from the supporting area. The surface pressure and hence the stress in the material can likewise be reduced there in this way. In the case of the through-holes arranged away from the supporting area of the base plate, it has also proven advantageous, with respect to the desired secure fixation of the base plate on the sleeper, if the inclined surface section is directed towards the supporting area. This alignment allows the same spike nails to be used for retaining the rail and the base plate, wherein errors during positioning are prevented by aligning all nails with the dame orientation.

In order to also minimise notch effects in the corner area, in which the supporting area and the contact surface of the support section respectively abutting on it there normally meet at a right angle, a groove extending over the width of the supporting area can also be formed into a corner area, in which the supporting area meets the respective contact surface of the respective support section.

In accordance with the preceding explanations, a rail fastening point according to the invention, in which a rail for a rail vehicle is fastened to a base structure, comprises a sleeper, a base plate according to the invention and at least one rail spike, which has a spike shaft, which is inserted through the through-hole assigned to the contact surface of the respective support section and driven into the sleeper, and a spike head, which is formed onto the spike shaft, protrudes in the direction of the supporting area of the base plate and which has a support surface on its underside assigned to the top side of the base plate, with which support surface it rests in full surface contact on the inclined surface of the through-hole and on the free top side of the rail foot of the rail supported on the supporting area of the base plate.

BRIEF DESCRIPTION OF THE DRAWINGS

The invention is explained in more detail based on a figure illustrating an exemplary embodiment. Each showing schematically.

Figure 1:
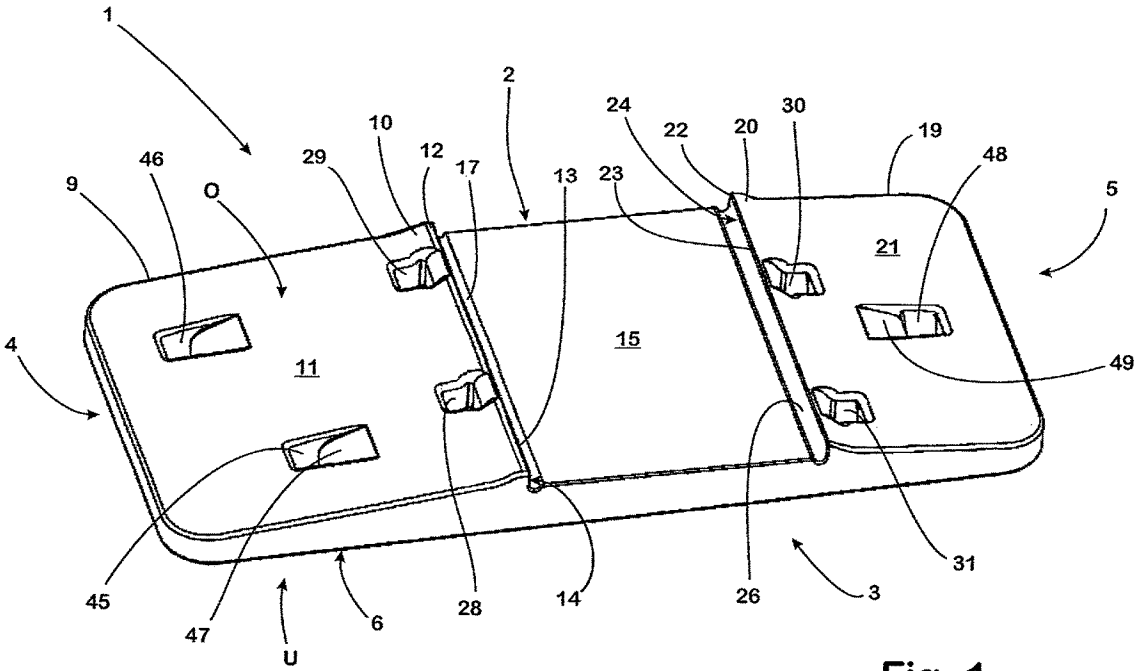
FIG. 1 a base plate in a perspective view.
Figure 2:
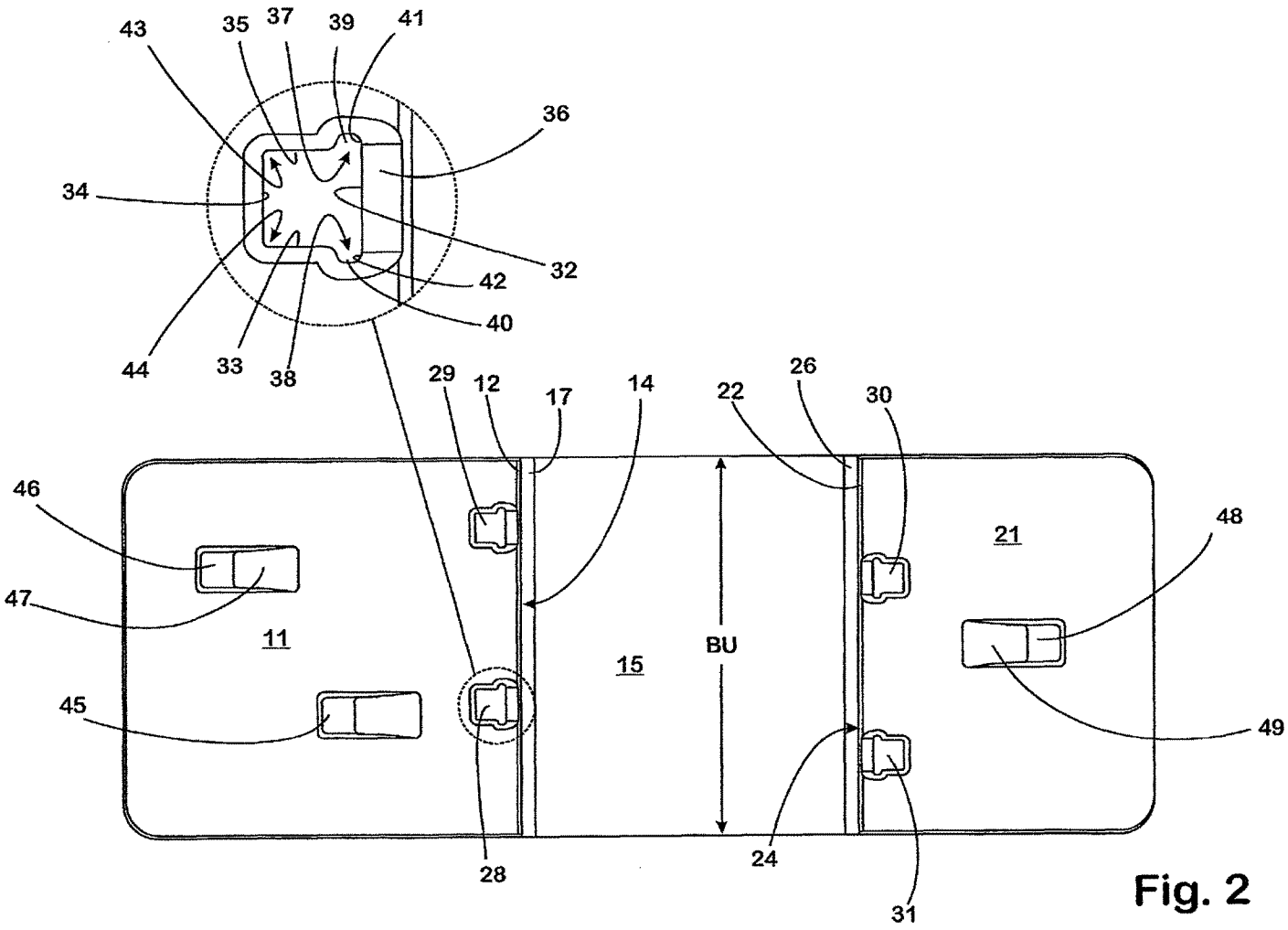
FIG. 2 the base plate in a plan view.
Figure 3:
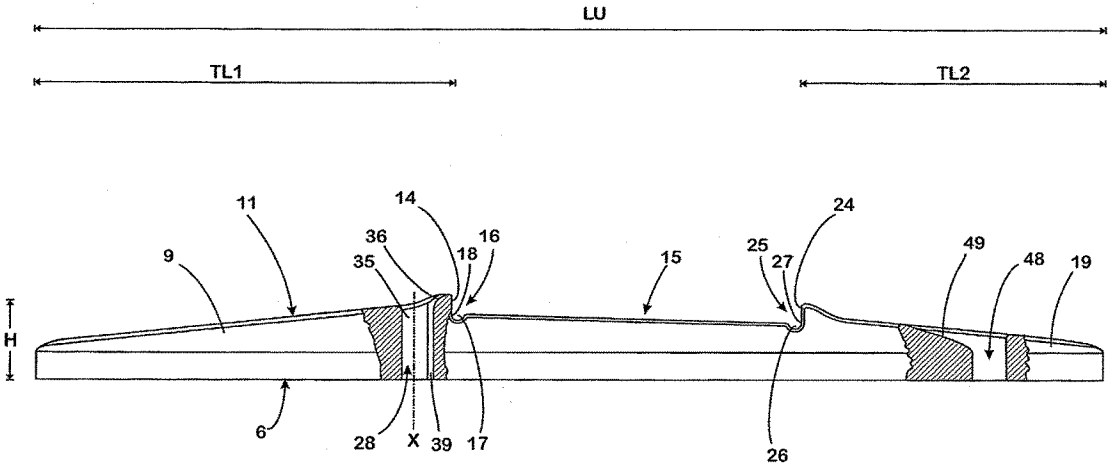
FIG. 3 the base plate in a frontal view of one of its longitudinal sides.

The base plate 1 completely formed from a plastic material, for example from a glass fibre reinforced polyamide plastic material with the DIN short description PA 6 GF 30 (glass fibre proportion 30%) in plan view has a rectangular, elongated basic shape with two longitudinal sides 2, 3 running parallel to one another in the longitudinal direction LU of the base plate 1 and two narrow sides 4, 5 which are also aligned parallel to one another and transverse to the longitudinal sides 2, 3 and which extend over the width BU of the base plate 1.

On its underside U, the base plate 1 has a flat seating surface 6, by means of which in the mounting position (FIG. 4) it rests on the flat supporting area 8 provided on the top side of a wooden sleeper 7.

DETAILED DESCRIPTION OF THE INVENTION

A first support section 9 is formed on the base plate 1 abutting on the one narrow side 4, this support section 9 taking up the whole width BU and a first part length TL1 of the base plate 1. On the top side O of the base plate 1 opposing the underside U, the support section 9 rises continuously like a roof surface starting from the narrow side 4 until it reaches a narrow edge area 10 aligned parallel to the narrow side 4. The gradient initially increases in the edge area 10 until the surface 11 of the support section 9 ends in a narrow edge strip 12 approximately parallel to the flat seating surface 6.

Thereby the surface 11 meets in an upper marginal edge 13 an end-face contact surface 14 of the support section 9 which is aligned perpendicular to the seating surface 6 and at right angles with the longitudinal sides 2, 3 of the base plate 1 and extends over its width BU.

The contact surface 14 laterally delimits a flat supporting area 15, on which with a fully mounted fastening point B using the base plate 1 (FIG. 4), a conventionally formed rail S rests with its rail foot SF.

A groove 17 which is U-shaped in cross-section and extends over the width BU is formed into the supporting area 15 in the corner area 16 in which the supporting area 15 and the contact surface 14 meet. The one leg surface 18 of the groove 17 forms an extension of the contact surface 14.

A second support section 19 is formed on the base plate 1 abutting on its second narrow side 5 and also extending over the width BU and a part length TL2 of the base plate 1. The part length TL2 is shorter than the part length TL1 of the first support section 9. Apart from that, however, the form of the support section 19 matches to the form of the support section 9. Accordingly, it too rises like a roof, starting from the narrow side 5 assigned to it, until it reaches an edge area 20, in which the gradient of the surface 21 of the second support section 19 increases, until it ends via an edge strip 22 aligned approximately parallel to the seating surface 6 at an upper marginal edge 23. The surface 21 of the second support section 19 meets a contact surface 24, which extends parallel to the contact surface 14 of the first support section 9 over the width BU, on the upper marginal edge 23 extending over the width BU. The second support section 19 delimits with its contact surface 24 the supporting area 15 of the base plate 1 on its narrow side.

Starting at the second support section 19, the supporting area 15 is inclined slightly rising like a roof surface in the direction of the first support section 9, in order to provide the rail S, which rests on it when the fastening point B is fully mounted, with a certain inclination.

A groove 26, which is U-shaped in cross-section and extends over the width BU, is also formed into the supporting area 15 in the corner area 25 in which the supporting area 15 and the contact surface 24 meet. As with the groove 17, a leg surface 27 of the groove 26 forms an extension of the assigned contact surface 24.

The risk of crack formation which could otherwise occur due to notch effects is minimised in the corner areas 16, 25 by the grooves 17, 26, which are arranged in such a way and cut into the supporting area 15.

Two through holes 28, 29, 30, 31 leading from the top side O to the underside U of the base plate 1 and distributed spaced apart from one another along the respective upper marginal edge 13, 23 are in each case positioned in the edge areas 10, 20 of the support sections 9, 19. The through-holes 28-31 have a rectangular basic form in the cross-section aligned transverse to their longitudinal axis X, wherein with respect to the lateral surfaces 32, 33, 34, 35 delimiting the through-holes 28-31 in each case, the two lateral surfaces 32, 34 are aligned parallel to the respectively assigned contact surface 14, 24, while the two other lateral surfaces 33, 35 are aligned transverse to them.

The lateral surfaces 33-35 are in each case aligned perpendicular to the flat seating surface 6 of the base plate 1 over the entire height H of the through-holes 28-31. The lateral surface 32 arranged parallel and closest adjacent to the respectively assigned contact surface 14, 24, on the other hand, starting from the seating surface 6 only extends over approximately two thirds of the height H and then changes smoothly into an inclined surface 36 which rises in the direction of the respectively assigned upper marginal edge 13, 23. Starting from the lateral surface 32, the inclined surface 36 is firstly outwardly curved in the manner of the outer peripheral surface of a cylinder segment around an axis which is aligned parallel to the respectively assigned marginal edge 13, 23 and is then ending in the edge strip 12, 22 of the respective support section 9, 19 abutting on the respective marginal edge 13, 23.

A U-shaped groove 39, 40 is respectively formed into the lateral surfaces 33, 35 in the corner areas 37, 38 in which the lateral surfaces 33, 35 meet the lateral surface 32, whose one leg surface 41, 42 forms an extension of the lateral surface 32. In the area of the inclined surface 36, the leg surfaces 41, 42 of the grooves 39, 40 form the lateral limits of the respective through-hole 28-31. For this purpose, they are respectively inwardly curved in the area concerned such that, looking at the through-hole in plan view, they tangentially clings to the base of the respective groove 39, 40 and meet in an arch the respectively assigned edge of the inclined surface 36. By means of the grooves 39, 40 and the inwardly curved form of their leg surfaces 41, 42 widened in the area of the inclined surface 36, the risk of crack formation through notch effects in the corner areas 37, 38 is likewise minimised. The fact that the corner areas 43, 44, in which the lateral surface 34 meets the lateral surfaces 33, 35, are hollowed out in a fillet-shaped manner also contributes to the minimization of the risk of crack formation.

In the longer first support sections 9, two further through-holes 45, 46, which are further away from the supporting area 15 and offset in the width direction in relation to the through-holes 28, 29 of the support section 9 and spaced apart from one another and offset in the longitudinal direction in relation to one another, are formed into the support section 9, whose basic shape corresponds to the shape of the through-holes 28, 29. However, in contrast to the through-holes 28, 29, in the case of the additional through-holes 45, 46 the inclined surface 47 directed towards the supporting area 15 starts at a lesser distance from the seating surface 6, so that in each case a longer ramp-like indentation rising in the direction of the supporting area 15 is formed into the top side O of the support section 9 by means of the inclined surface 47. In addition, in contrast to the through-holes 28, 29, in the case of the additional through-holes 45, 46 no stress-relieving grooves were formed in the corner areas of the lateral surfaces delimiting the through-hole.

A further additional through-hole 48, matching the shape of the through-holes 45, 46, is formed offset centrally in relation to the through-holes 30, 31 and towards the narrow side 5 of the base plate 1 into the shorter support section 19. The inclined surface 49 of this additional through-hole 48 is also aligned at right angles with and in the direction of the supporting area 15 here.

Figure 4:
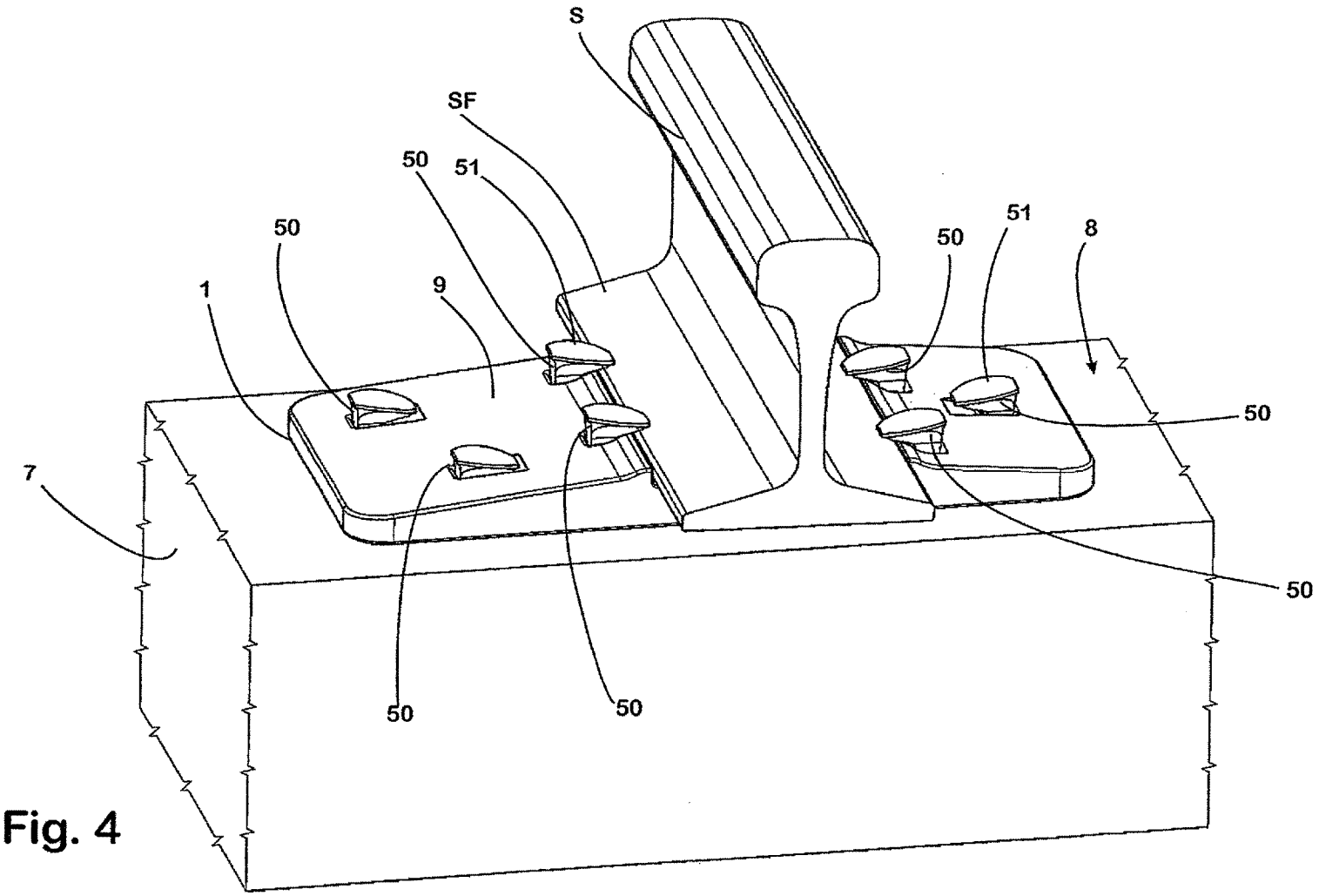
FIG. 4 a rail fastening point formed using the base plate, in a perspective view.

In order to mount the rail fastening point B shown in FIG. 4, the base plate 1 is placed with its seating surface 6 onto the supporting area 8 of the wooden sleeper 7. Then, the rail S is positioned with its rail foot SF on the supporting surface 15 of the base plate 1 which is accordingly aligned transverse to the longitudinal direction of the rail S with the wooden sleeper 7. The rail foot SF fits between the contact surfaces 14, 24 of the support sections 9, 19, through which the rail S is laterally guided and supported in the rail fastening point B.

Rail spikes 50 are driven though the through-holes 28-31 and the additional through-holes 45, 46, 48 into the wooden sleeper 7 to fasten the rail S and the base plate 1 to the wooden sleeper 7. The rail spikes 50 each have a spike shaft, which is not visible here and rectangular in cross-section, and a spike head 51 which protrudes over one side of the spike shaft and has a support surface on its underside facing the base plate 1, wherein this support surface is merging in an inward curvature, corresponding to the outward curvature of the respective inclined surface 36, 47 of the through-holes 28-31 and 45, 46, 48 into the respectively assigned lateral surface of the spike shaft. Correspondingly, the rail spikes 50 each abut with the underside of their respective spike head 51 in full surface contact on the assigned inclined surface 36, 47 of the through-holes 28-31 and 45, 46, 48.

In the case of the rail spikes 50 driven into the through-holes 28-31 assigned to the respective contact surface 14, 24, the spike heads 51 protrude beyond the assigned longitudinal edge of the rail foot SF. They correspondingly rest on the free top side of the rail foot SF and, in this way, hold the rail S with the required retaining force on the sleeper 7. In the case of the rail spikes 50 driven into the additional through-holes 45, 46 and 48, the spike heads 51, on the other hand, rest with the whole length of the support surface formed on its underside in full surface contact on the respectively assigned inclined surface 36, 47 of the additional through-holes 45, 46, 48, so that there too the surface pressure is evened out and the risk of crack formation or fracture is minimised.

LIST OF REFERENCE SYMBOLS

1 Base plate
2, 3 Longitudinal sides of the base plate 1
4, 5 Narrow sides of the base plate 1
6 Seating surface of the base plate 1
7 Wooden sleeper
8 Supporting area of the wooden sleeper 7
9 First support section of the base plate 1
10 Edge area of the support section 9
11 Surface of the support section 9
12 Edge strip of the support section 9
13 Upper marginal edge delimiting the contact surface 14
14 Contact surface of the support section 9
15 Supporting area of the base plate 1

16 Corner area between the supporting area 15 and the contact surface 14
17 U-shaped groove
18 Leg surface of the groove 17
19 Second support section of the base plate 1
20 Edge area of the second support section 19
21 Surface of the second support section 19
22 Edge strip of the second support section 19
23 Upper marginal edge delimiting the contact surface 24
24 Contact surface of the second support section 19
25 Corner area between the supporting area 15 and the contact surface 24
26 U-shaped groove
27 Leg surface of the groove 26
28-31 Through-holes
32-35 Lateral surfaces respectively delimiting the through-holes 28-31
36 Inclined surface of the through-holes 28-31
37, 38 Corner areas in which the lateral surfaces 33, 35 meet the lateral surface 32
39, 40 U-shaped grooves
41, 42 Leg surfaces of the grooves 39, 40
43, 44 Corner areas in which the lateral surface 34 meets the lateral surfaces 33, 35
45, 46 Additional through-holes of the first support section 9
47 Respective inclined surface of the additional through-holes 45, 46
48 Additional through-hole of the second support section 19
49 Inclined surface of the additional through-hole 48
50 Rail spikes
51 Respective spike head of the rail spikes 50
B Rail fastening point
BU Width of the base plate 1
H Height of the through-holes 28-31
LU Longitudinal direction of the base plate 1
O Top side of the base plate 1
S Rail
SF Rail foot
TL1 Part length of the base plate 1 taken up by the support section 9
TL2 Part length of the base plate 1 taken up by the support section 19
U Underside of the base plate 1
X Longitudinal axis of the through-holes 28-31.

The invention claimed is:

1. A base plate for a rail fastening point, comprising at least one lateral support section which has a lateral contact surface which delimits a supporting area formed on a top side of the base plate, extending over a width of the base plate for a foot of a rail for a rail vehicle which is to be attached to the base plate, wherein a through-hole leading from the top side to an underside of the support section is formed into an edge area of the support section abutting on the lateral contact surface, to insert a rail spike through the through-hole, the through-hole having a basic shape which is angular in cross-section, and wherein a surface of the edge area meets with the contact surface in an upper marginal edge, wherein, starting from the underside of the support section, a lateral surface of the through-hole assigned to the contact surface rises in a first direction over a partial height of the through-hole whereupon the lateral surface of the through-hole assigned to the contact surface changes into an inclined surface which rises in a second direction of the upper marginal edge of the contact surface and ends at the surface of the edge area.

2. The base plate according to claim 1, wherein an upper end of the inclined surface ends at the surface of the edge area and butts against the upper marginal edge of the contact surface.

3. The base plate according to claim 1, wherein the inclined surface extends over at least one sixth of the height of the through-hole.

4. The base plate according to claim 1, wherein the inclined surface is at least in sections curved.

5. The base plate according to claim 2, wherein a groove respectively formed at least into corner areas of the lateral surface of the through-hole assigned to the contact surface outside of the inclined surface butts against the lateral surface of the through-hole over the partial height of the through-hole.

6. The base plate according to claim 5, wherein the groove is U-shaped and a leg surface of the groove forms an extension of the lateral surface of the through-hole assigned to the contact surface.

7. The base plate according to claim 6, wherein the groove extends into the area of the inclined surface, and in that the leg surface of the groove adjoining the inclined surface is inwardly curved in such a way that viewed in cross-section, on the one hand, the leg surface of the groove tangentially clings to a base surface of the groove and, on the other hand, the leg surface of the groove butts against the lateral edge of the inclined surface assigned to the contact surface.

8. The base plate according to claim 1, wherein two or more through-holes are formed into the support section and are distributed spaced apart from one another along the upper marginal edge of the contact surface of the support section.

9. The base plate according to claim 1, wherein the base plate has two support sections, each of which is provided with at least one through-hole and wherein the support sections have opposing lateral contact surfaces that delimit the supporting area in each case on one side of the supporting area.

10. The base plate according to claim 1, wherein an additional through-hole leading from the top side to the underside of the base plate and offset in a direction of an outer narrow side of the base plate remote from the supporting area is formed into at least one of the support sections, this additional through hole having at least one lateral surface which at least in one surface section abutting on the surface of the support section is inclined rising in a direction of the surface of the support section.

11. The base plate according to claim 10, wherein the inclined surface section is directed towards the supporting area.

12. The base plate according to claim 1, wherein a groove extending over the width of the supporting area is formed into a corner area, in which the supporting area meets the respective contact surface of the respective support section.

13. The base plate according to claim 1, wherein the base plate is produced from a plastic material.

14. A rail fastening arrangement, in which a rail for a rail vehicle is fastened to a base structure, comprising a sleeper, a base plate designed according to claim 1 and at least one rail spike, which has a spike shaft, which is inserted through the through-hole assigned to the contact surface of the respective support section and driven into the sleeper, and a spike head, which is formed onto the spike shaft, protrudes in a direction of the supporting area of the base plate, wherein an underside of the spike head has a support surface assigned to the top side of the base plate, which support surface rests in full surface contact on the inclined surface of the through-hole and on a free top side of the rail foot of the rail supported on the supporting area of the base plate.

* * * * *